US010915058B1

(12) United States Patent
Kouzu

(10) Patent No.: US 10,915,058 B1
(45) Date of Patent: Feb. 9, 2021

(54) IMAGE FORMING APPARATUS WITH A ROLLER, A PRESSING PART, A LEVER, A COVER, AND AN ENGAGEMENT PART

(71) Applicant: TOSHIBA TEC KABUSHIKI KAISHA, Tokyo (JP)

(72) Inventor: Norio Kouzu, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/794,033

(22) Filed: Feb. 18, 2020

(51) Int. Cl.
*G03G 21/16* (2006.01)
*G03G 15/16* (2006.01)

(52) U.S. Cl.
CPC ..... *G03G 21/1638* (2013.01); *G03G 15/1615* (2013.01)

(58) Field of Classification Search
CPC ..... G03G 21/1638; G03G 15/1615
See application file for complete search history.

(56) References Cited

U.S. PATENT DOCUMENTS 7,487,967 B2 * 2/2009 Uchida ..... B65H 29/12 399/124
2002/0061212 A1 * 5/2002 Tanaka ..... G03G 15/605 399/379

FOREIGN PATENT DOCUMENTS

JP 2013097372 A 5/2013

* cited by examiner

*Primary Examiner* — Susan S Lee
(74) *Attorney, Agent, or Firm* — Kim & Stewart LLP

(57) ABSTRACT

An image forming apparatus includes a rotating belt in a main body. A roller is supported by a support shaft that moves the roller into contact with the rotating belt and away from the rotating belt. A pressing part in the main body is configured to press the support shaft so that the roller presses against the rotating belt. A lever is provided that when moved causes the pressing part to move between a first position, pressing the support shaft, and a second position, away from the support shaft. A openable and closable cover covers the main body and rotates about a first axis. An engagement part is fixed to the cover and moves with rotation of the cover. The engagement part engages the lever when the cover is closed and releases the lever when the cover is opened.

20 Claims, 11 Drawing Sheets

IMAGE FORMING APPARATUS WITH A ROLLER, A PRESSING PART, A LEVER, A COVER, AND AN ENGAGEMENT PART

FIELD

Embodiments described herein relate generally to an image forming apparatus.

BACKGROUND

In an image forming apparatus, such as a printer, paper may become jammed along a paper conveyance path. It is desirable that a user can easily remove the jammed paper from the conveyance path. Thus, roller pairs abutting each other along the conveyance path are often provided with a release mechanism to permit release of the paper from between the roller pair.

For example, when the image forming apparatus includes various support rollers that support an intermediate transfer belt or the like from inside the belt's loop along with secondary transfer rollers that face these support rollers, with the intermediate transfer belt interposed therebetween, the secondary transfer rollers may be held in place by a side cover panel of the image forming apparatus housing or the like. The side cover panel is in turn supported by front and rear panels of the image forming apparatus.

In such a case, when the user opens or removes the side cover panel, the secondary transfer rollers, which are connected to the side cover panel, are separated from the intermediate transfer belt. Thus, for example, the paper conveyance path from a registration roller to a secondary transfer position is made accessible. Therefore, the paper jam is more easily removed.

However, when the user closes or replaces the side cover panel, the secondary transfer rollers must be positioned so as to engage a drive roller, via the intermediate transfer belt interposed therebetween, at the secondary transfer position.

When the roller contacts and is separated from another rotating body provided in an apparatus main body in association with the opening and closing of the cover, a contact and separation operation between the roller and the other rotating body may not be smoothly performed. If a relative position with respect to the other rotating body is deviated when the roller abuts thereon, the transfer paper cannot be normally conveyed. Therefore, the roller is required to be firmly positioned at a fixed position in the apparatus main body. Further, the roller positioned at the fixed position is required to be pressed against the other rotating body in order to form a nip with the other rotating body.

Since a pressing force is superimposed on an opening and closing force of the cover depending on a configuration of a mechanism that generates the pressing force when the cover is closed, the cover may not be smoothly opened and closed. In order to improve the opening and closing properties of the cover, the pressing force is also considered to be reduced; however, in this case, the positioning accuracy of the roller may deteriorate.

DETAILED DESCRIPTION

An image forming apparatus according to an embodiment includes a main body, a rotating belt in the main body; and a roller. The roller is supported by a support shaft that is configured to move the roller into contact with the rotating belt and to separate the roller from rotating belt. A pressing part in the main body is configured to press the support shaft so that the roller presses against the rotating belt. A lever is provided that when moved causes the pressing part to move between a first position pressing the support shaft and a second position away from (separated from) the support shaft. A cover covers an outer periphery of the main body and is rotatably supported about a first axis of a rotating support part in the main body so as to be openable and closable. An engagement part is fixed to the cover and moves on a circular arc around the first axis with rotation of the cover. The engagement part is positioned to engage the lever when the cover is closed such that the lever is at the first position and to release the lever when the cover is opened to permit the lever to move to the second position.

Example Embodiment

Hereinafter, an image forming apparatus according to example embodiments will be described with reference to the accompanying drawings. In the following drawings, unless otherwise specified, the same or substantially corresponding aspects and/or elements will be denoted by the same reference labels.

Figure 1:
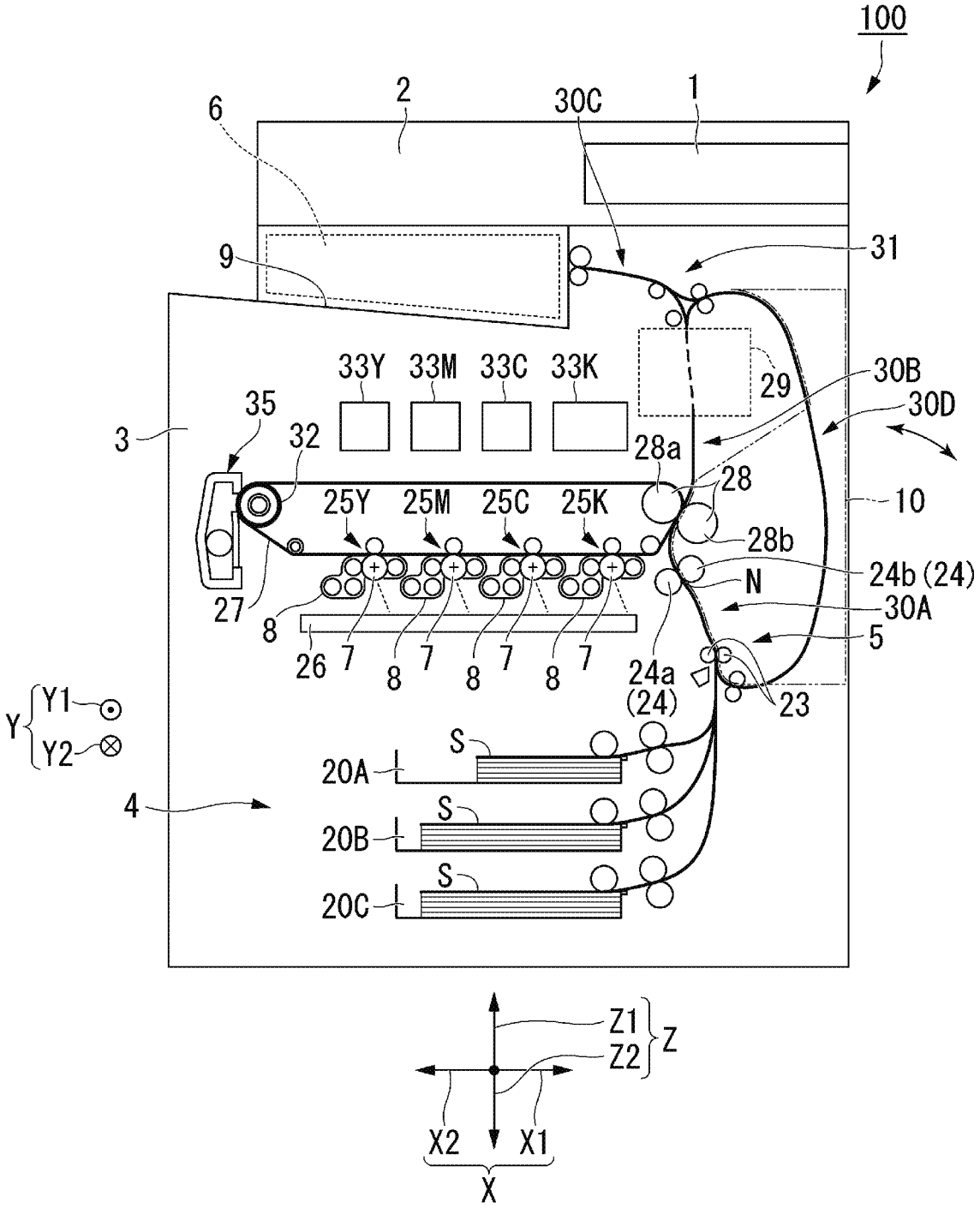
FIG. 1 is a schematic cross-sectional view illustrating an example of an overall configuration of an image forming apparatus according to an embodiment.

FIG. 1 is a schematic cross-sectional view illustrating an example of an overall configuration of an image forming apparatus according to an embodiment.

As illustrated in FIG. 1, an image forming apparatus 100 according to an embodiment includes a control panel 1, a scanner section 2, a printer section 3, a sheet supply section 4, a conveyance mechanism 5, and a main body control section 6.

When referring to a relative position in the image forming apparatus 100, the directional notations X1 (horizontal, page right in FIG. 1), X2 (horizontal, page left in FIG. 1), Y1 (outward from page plane in FIG. 1), Y2 (inward from page plane in FIG. 1), Z1 (vertical, page up in FIG. 1), and Z2 (vertical, page down in FIG. 1) as illustrated in the FIG. 1 may be used. When it is not required to indicate or refer to a specific direction (orientation) along the depicted X axis, Y axis, or Z axis, then such a direction may be simply referred to as the X, Y, or Z direction as appropriate.

The control panel 1 operates the image forming apparatus 100 according to inputs from a user.

The scanner section 2 reads image information of an object to be copied as light and darkness. The scanner section 2 outputs the read image information to the printer section 3.

The printer section 3 forms an image on a sheet S based upon the image information from the scanner section 2 or from the outside.

The printer section 3 outputs a toner image using a developer containing toner. The printer section 3 transfers this toner image to the surface of a sheet S. The printer section 3 then fixes the toner image to the sheet S by applying heat and pressure to the toner image on the surface of the sheet S.

The sheet supply section 4 supplies sheets S one by one to the printer section 3 for the printer section 3 to form a toner image thereon.

The sheet supply section 4 includes a plurality of paper feeding cassettes 20A, 20B, and 20C.

The sheet supply section 4 supplies the sheets S required for image formation processing from each of the paper feeding cassettes 20A, 20B, and 20C as necessary. The sheet supply section 4 conveys each sheet S to the conveyance path 5 for the printer section 3.

The conveyance path 5 includes a conveyance roller 23 and a registration roller pair 24. The conveyance path 5 conveys each sheet S supplied from the sheet supply section 4 to the registration roller pair 24.

The registration roller pair 24 conveys the sheet S at a timing for the printer section 3 to transfer the toner image to the sheet S at the appropriate position on the sheet S.

The registration roller pair 24 comprises a first roller 24*a* positioned on the X2 direction side and a second roller 24*b* positioned on the X1 direction side. The conveyance path of the sheet S is interposed between first roller 24*a* and the second roller 24*b*.

The first roller 24*a* is rotationally driven by a drive element which is not separately illustrated. The second roller 24*b* can be positioned to contact the first roller 24*a* and can be moved to another position separated from the first roller 24*a*.

The first roller 24*a* and the second roller 24*b* include gears coaxially with respective central axes. The respective gears are engaged (enmeshed) with each other when the second roller 24*b* contacts the first roller 24*a*. The second roller 24*b* receives a drive force from the first roller 24*a* by meshed gears. Accordingly, the second roller 24B rotates at the same velocity as that of the first roller 24*a* but in a rotational direction opposite to the first roller 24*a*.

The conveyance roller 23 contacts a tip portion (leading edge) of the sheet S against a nip N of the registration roller pair 24. The conveyance roller 23 adjusts a position of the tip portion of the sheet S by bending the sheet S.

The registration roller pair 24 positions the tip of the sheet S at the nip N. The registration roller pair 24 then conveys the sheet S to a transfer section 28.

The printer section 3 includes image forming sections 25Y, 25M, 25C, and 25K, an exposure unit 26, an intermediate transfer belt 27, a transfer section 28, a fixing device 29, and a transfer belt cleaning unit 35.

The image forming sections 25Y, 25M, 25C, and 25K are disposed in this order in the X1 direction.

Each of the image forming sections 25Y, 25M, 25C, and 25K forms the toner image on the intermediate transfer belt 27 to be transferred to the sheet S.

The image forming sections 25Y, 25M, 25C, and 25K each include a photosensitive drum 7. The image forming sections 25Y, 25M, 25C, and 25K form yellow, magenta, cyan, and black toner images on the respective photosensitive drums 7.

A charging device, a developing device 8, a primary transfer roller, a cleaning unit, and a static eliminator are positioned around the respective photosensitive drums 7. The primary transfer roller faces the photosensitive drum 7. The intermediate transfer belt 27 passes between the primary transfer roller and the photosensitive drum 7. The exposure unit 26 is disposed below the charging device and the developing device 8.

Toner cartridges 33Y, 33M, 33C, and 33K are disposed above the image forming sections 25Y, 25M, 25C, and 25K. The toner cartridges 33Y, 33M, 33C, and 33K respectively contain yellow, magenta, cyan, and black toners.

The toners from the respective toner cartridges 33Y, 33M, 33C, and 33K are supplied to the image forming sections 25Y, 25M, 25C, and 25K by a toner supply pipe, duct or the like.

The exposure unit 26 irradiates a surface of the charged photosensitive drums 7 with light such as a laser beam. The emission of the light is controlled based upon the image information (e.g., the image data for the intended image and/or text to be printed). A configuration in which the exposure unit 26 incorporates LED light(s) instead of a laser can also be adopted. In the example illustrated in FIG. 1, the exposure unit 26 is disposed below the image forming sections 25Y, 25M, 25C, and 25K.

The image information corresponding to yellow, magenta, cyan, and black portions of an image to be formed is supplied to the exposure unit 26.

The exposure unit 26 forms an electrostatic latent image based upon the image information on the surface of each photosensitive drum 7.

The intermediate transfer belt 27 is, for example, a closed loop, which may be referred to as an endless belt. A tension is applied to the intermediate transfer belt 27 by a plurality of rollers abutting on an inner peripheral (inside) surface of the intermediate transfer belt 27. The intermediate transfer belt 27 is stretched to have a flat portion. In this example, the inner peripheral surface of the intermediate transfer belt 27 abuts on a support roller 28*a* at a position in the X1 direction that is farthest along the stretching direction/dimension. The inner peripheral surface of the intermediate transfer belt 27 abuts on a transfer belt roller 32 at a position in the X2 direction that is most separated in the stretching direction/dimension from the support roller 28*a*.

The support roller 28*a* forms a part of the transfer section 28. The support roller 28*a* guides the intermediate transfer belt 27 to the secondary transfer position.

The transfer belt roller 32 guides the intermediate transfer belt 27 to a cleaning position.

The image forming sections 25Y, 25M, 25C, and 25K excluding the primary transfer roller are disposed in this order in the X1 direction on the lower surface side of the intermediate transfer belt 27 illustrated in the drawing. The image forming sections 25Y, 25M, 25C, and 25K are disposed in a region between the transfer belt roller 32 and the support roller 28*a* with a space therebetween.

When the toner image reaches a primary transfer position, a transfer bias is applied to each of the primary transfer rollers of the image forming sections 25Y, 25M, 25C, and 25K. Each primary transfer roller transfers the toner image from the surface of each photosensitive drum 7 onto the intermediate transfer belt 27. This transfer is referred to as a primary transfer.

In the intermediate transfer belt 27, the transfer section 28 is disposed at a position adjacent or nearest to the image forming section 25K.

The transfer section 28 includes the support roller 28*a* and a secondary transfer roller 28*b*. The intermediate transfer belt 27 passes between the secondary transfer roller 28*b* and the support roller 28*a*. The position at which the secondary transfer roller 28*b* and the intermediate transfer belt 27 meet each other is referred to as the secondary transfer position.

The transfer section 28 is used to transfer the toner image formed on the intermediate transfer belt 27 to the surface of the sheet S at the secondary transfer position. The transfer section 28 applies a transfer bias at the secondary transfer position. The transfer section 28 transfers the toner image on the intermediate transfer belt 27 to the sheet S by using the transfer bias.

The fixing device 29 then applies heat and pressure to the sheet S. The fixing device 29 fixes the toner image to the sheet S by the heat and the pressure. The fixing device 29 is disposed above the transfer section 28.

The transfer belt cleaning unit 35 faces the transfer belt roller 32. The intermediated transfer belt 27 passes between transfer belt cleaning unit 35 and transfer belt roller 32. The transfer belt cleaning unit 35 scrapes off toner from the surface of the intermediate transfer belt 27 as it passes.

Conveyance paths 30A and 30B for conveying the sheet S respectively pass between the registration roller pair 24 and the transfer section 28 and between the transfer section 28 and the fixing device 29.

A conveyance path 30C for discharging the sheet S in the X2 direction is formed above the fixing device 29. A discharge tray 9 on which sheets S discharged from the conveyance path 30C can be placed is provided below the exit of the conveyance path 30C.

A conveyance direction switching section 31 (sheet reversing section) that switches the conveyance direction of the sheet S is provided above the fixing device 29.

A conveyance path 30D that conveys the sheet S from the conveyance direction switching section 31 back to the registration roller pair 24 is formed inside the printer section 3 on the X1 direction side from the conveyance paths 30A and 30B. For example, when performing double-sided printing, the conveyance path 30D is used for reversing the one-sided printed sheet S for feeding the reversed sheet S to the registration roller pair 24 for second side printing.

The conveyance paths 30A, 30B, 30C, and 30D include various conveyance guide parts that face each other with the sheet S to be interposed therebetween, conveyance rollers provided as necessary for sheet conveyance.

The printer section 3 further includes a side cover unit 10. The side cover unit 10 is provided at an end of the printer section 3 in the X1 direction. An outer surface of the side cover unit 10 in the X1 direction forms a side surface of the printer section 3 in the X1 direction.

The side cover unit 10 includes a part of the above-described conveyance paths 30A, 30B, 30C, and 30D, the secondary transfer roller 28*b*, and the second roller 24*b*. Particularly, as for the conveyance paths 30A and 30B, the side cover unit 10 includes a conveyance guide part on the X1 direction side of the conveyance paths 30A and 30B.

The side cover unit 10 is mounted on a main body portion of the printer section 3. The side cover unit 10 is mounted so as to be rotatable about an axis extending in the Y direction. The side cover unit 10 can be opened and closed by a user using an integrated or attached part, such as a handle or a lever which in this instance are not separately illustrated on the side cover unit 10.

When the conveyance guide part on the X1 direction side of the conveyance paths 30A and 30B is rotated toward the X1 direction with the side cover unit 10, the conveyance guide part on the X2 direction side of the conveyance paths 30A and 30B is exposed. Therefore, when a sheet S is jammed along one of the conveyance paths 30A and 30B, jam removal processing can be performed by opening the side cover unit 10.

The main body control section 6 controls the various elements of the image forming apparatus 100.

Figure 2:
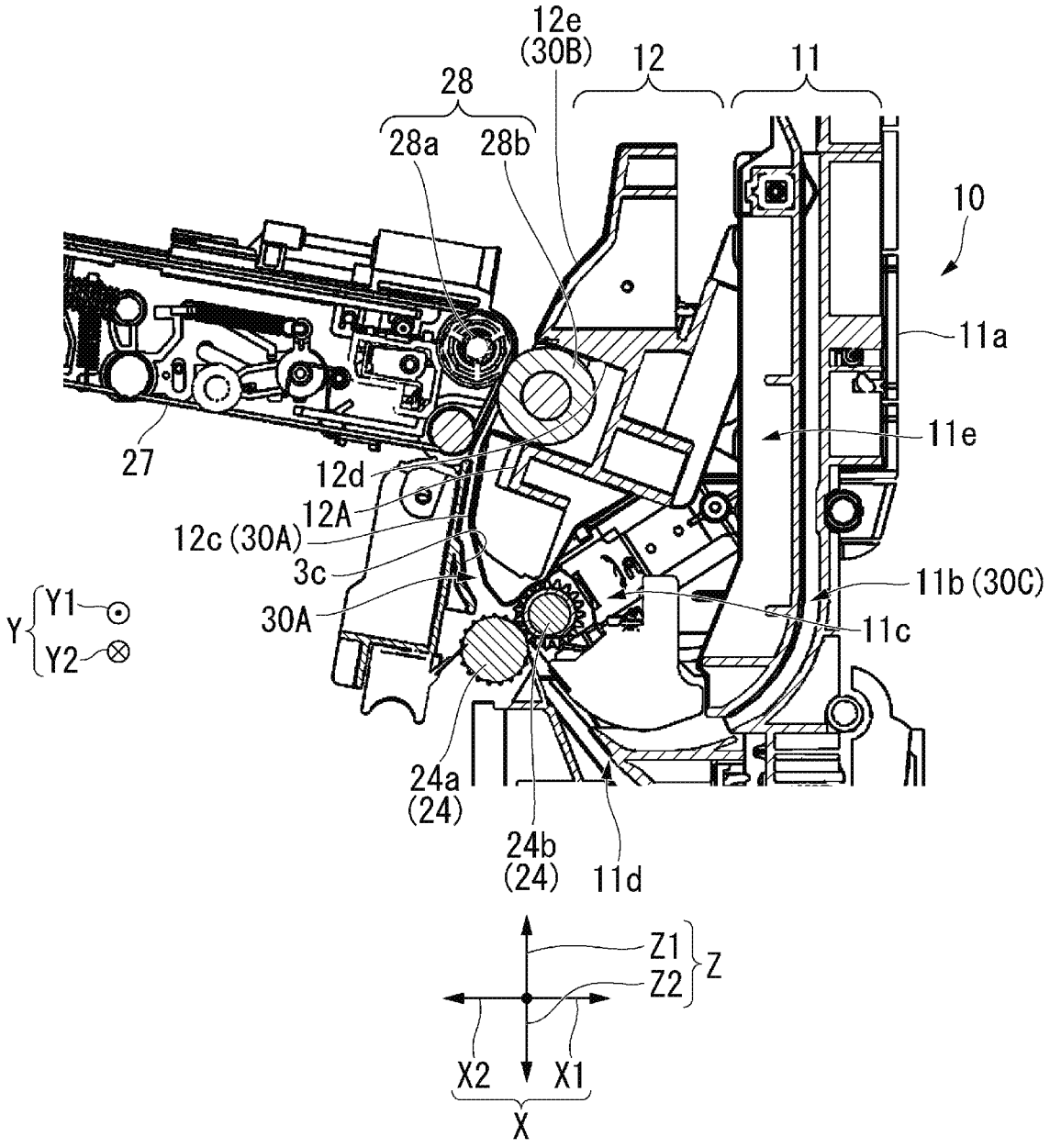
FIG. 2 is a schematic cross-sectional view illustrating an example of a side cover unit.
Figure 3:
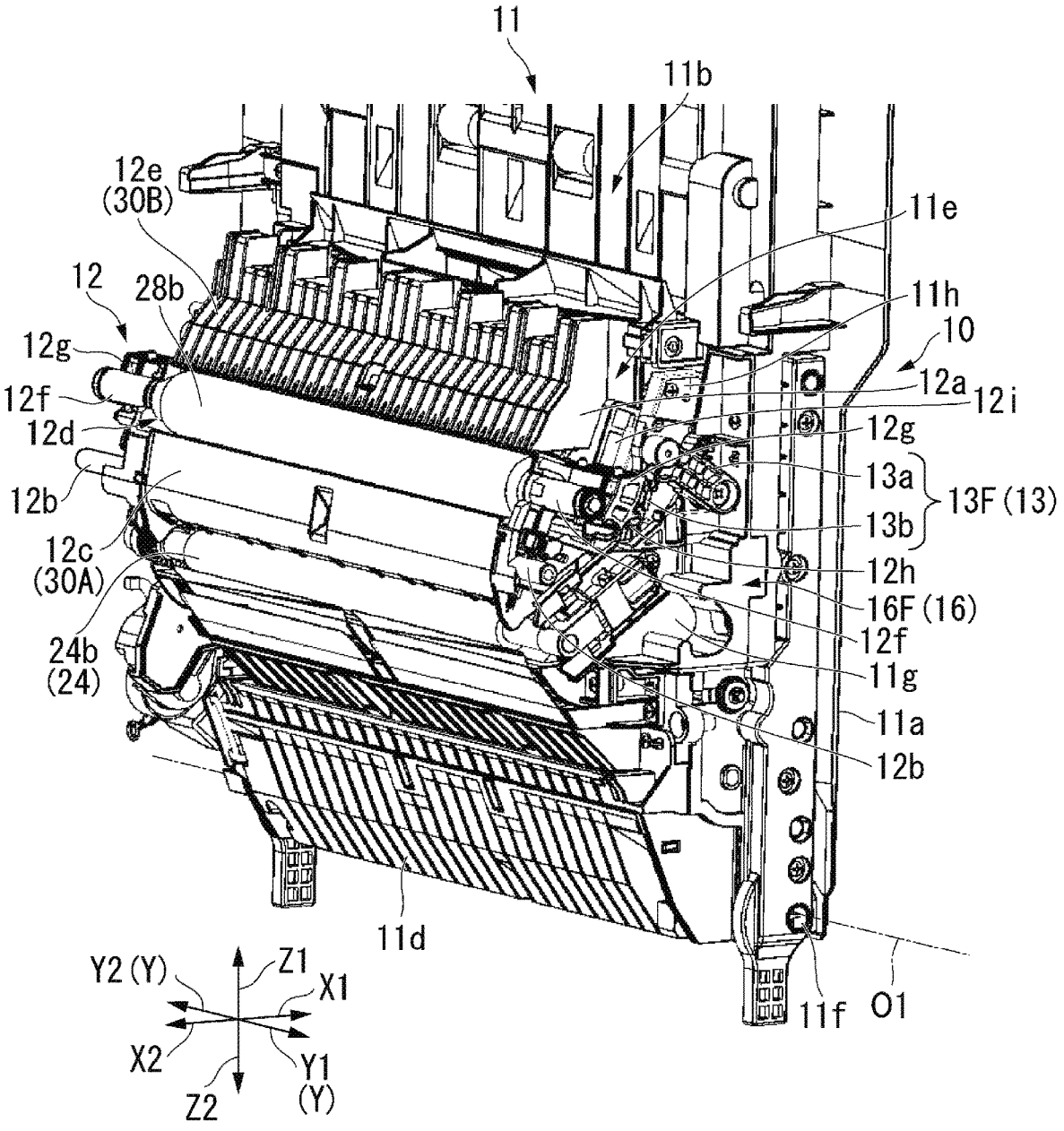
FIG. 3 is a schematic perspective view illustrating an example of the side cover unit.
Figure 4:
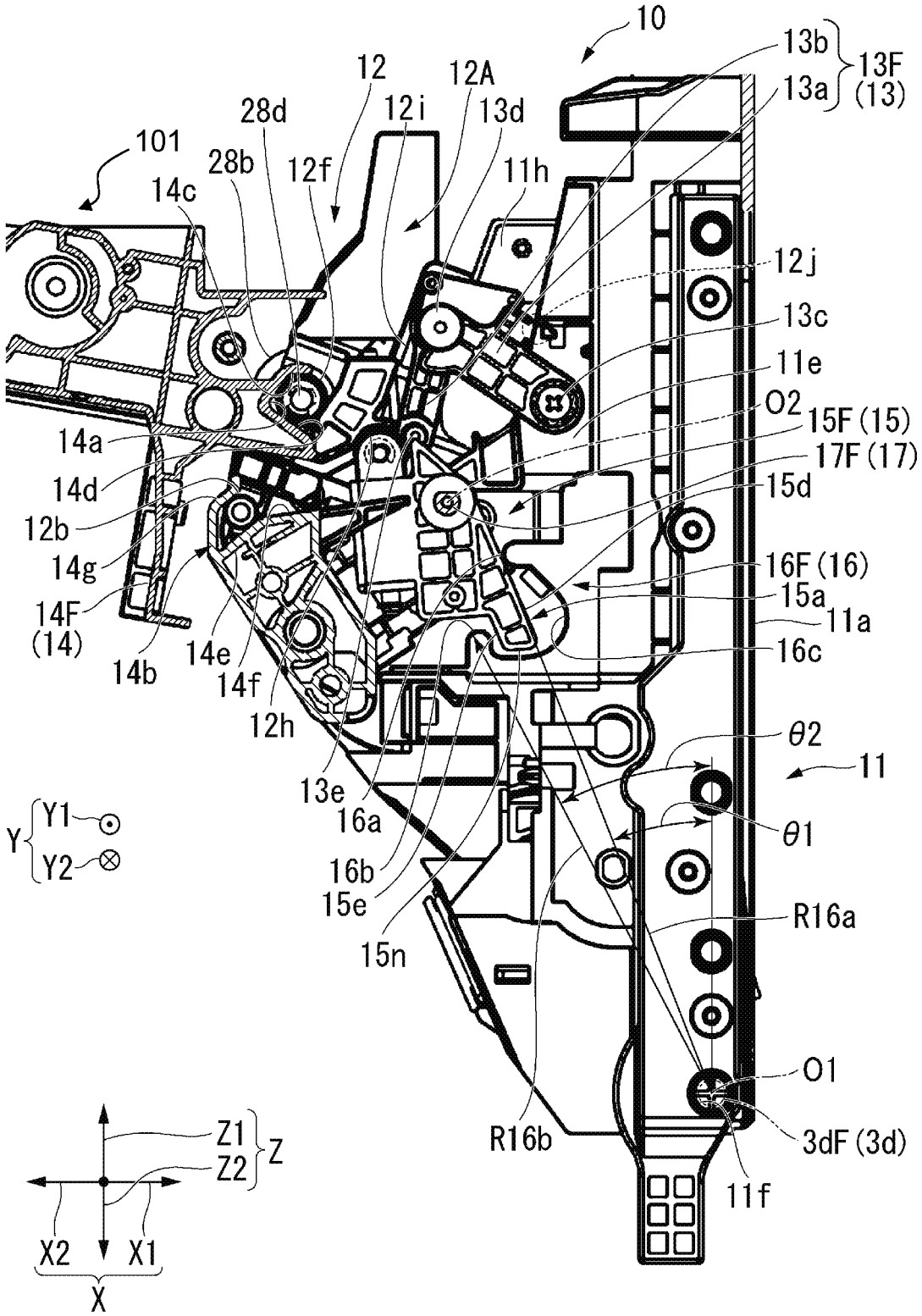
FIG. 4 is a schematic cross-sectional view illustrating a relationship between the side cover unit and an apparatus main body.

FIG. 2 is a schematic cross-sectional view illustrating an example of a side cover unit 10 in an image forming apparatus 100 according to an embodiment. FIG. 3 is a schematic perspective view illustrating an example of the side cover unit 10 according to the embodiment. FIG. 4 is a schematic cross-sectional view illustrating a relationship between the side cover unit 10 and an apparatus main body 101 (only a portion thereof is depicted in the figure) of the image forming apparatus 100 according to the embodiment.

FIG. 2 illustrates the side cover unit 10 when closed. Hereinafter, unless otherwise specified, the configuration of the side cover unit 10 will be described based upon a posture of the side cover unit 10 when closed/installed.

The side cover unit 10 includes a cover main body 11 and a transfer roller unit 12.

The cover main body 11 includes an exterior part 11*a*, a conveyance part 11*b*, a registration roller holding part 11*c*, a transfer roller unit holding part 11*e*, and an engagement part 16.

The exterior part 11*a* is the part exposed as the outside surface of the printer section 3 on the X1 direction side. The exterior part 11*a* may include a jam processing cover, a manual feed unit, and the like to open (provide access to) the conveyance path 30C at the conveyance part 11*b*

In this example, conveyance part 11*b* forms at least a part of the conveyance path 30C. The conveyance part 11*b* is provided inside (X2 direction side) of the exterior part 11*a*.

The registration roller holding part 11*c* holds the second roller 24*b* so that the first roller 24*a*, which is disposed on the apparatus main body side (side generally facing the interior of the imaging apparatus 100), can be pressed by the second roller 24*b*.

A conveyance guide part 11*d* forming a part of the conveyance path from the conveyance roller 23 (refer to FIG. 1) to the registration roller pair 24 is formed in the cover main body 11 near the registration roller holding part 11*c*.

The transfer roller unit holding part 11*e* holds the transfer roller unit 12.

As illustrated in FIG. 3, a hole 11*f* recessed in the Y2 direction is provided on a side part in the Y1 direction at a lower end part of the cover main body 11. Although not specifically illustrated in FIG. 3, another hole 11*f* is also provided on a side part in the Y2 direction of the cover main body 11. These two respective hole parts 11*f* are disposed coaxially with the first axis O1 extending along the Y direction. Here, the hole 11*f* on the side part in the Y2 direction is recessed in the Y1 direction. The respective holes 11*f* have a mutually plane-symmetrical shape.

Support shafts 3*d*B and 3*d*F (refer to FIG. 5), provided in the frame portion of the printer section 3 are to be inserted into the respective holes 11*f*. Accordingly, the cover main body 11 is mounted so as to be rotatable about the first axis O1 on the support shafts 3*d*B and 3*d*F.

Engagement parts 16 are fixed on both side surfaces in the Y direction of the cover main body 11. Each engagement part 16 has a shape and arrangement mutually plane-symmetric with respect to a plane that bisects a distance between a front side plate 3*a* and a rear side plate 3*b* (see FIG. 5) in the Y direction. Hereinafter, when distinguishing between the respective engagement parts 16 on different side, the engagement part 16 on the Y1 direction side is referred as an engagement part 16F, and the engagement part 16 on the Y2 direction side is referred to as an engagement part 16B.

Each engagement part 16 engages with a lever part 15*a* of a pressing mechanism 15 and moves the lever part 15*a* according to the opening and closing of the side cover unit 10.

As illustrated in FIG. 2, the transfer roller unit 12 includes the secondary transfer roller 28*b* and a unit main body 12A.

The unit main body 12A supports the secondary transfer roller 28*b*. The unit main body 12A is contacts the transfer roller unit holding part 11*e* and can be separated from the transfer roller unit holding part 11*e*.

A first conveyance guide part 12*c*, a secondary transfer roller holding part 12*d*, and a second conveyance guide part 12*e* are formed on the X2 direction side surface of the unit main body 12A from the lower side to upper side.

The first conveyance guide part 12*c* faces a conveyance guide part 3*c* disposed in the apparatus main body 101 (or a frame portion) of the printer section 3. The first conveyance guide part 12*c* forms the conveyance path 30A together with the conveyance guide part 3*c*.

The secondary transfer roller holding part 12*d* is a recessed portion that accommodates the secondary transfer roller 28*b*. As illustrated in FIG. 3, a bearing holder 12*g* and a locking shaft 12*b* are provided on a side surface of the transfer roller unit 12 in the Y1 direction. In FIG. 3, the bearing holder 12*g* and the locking shaft 12*b* have a shape and arrangement that are plane-symmetric to each other. The bearing holder 12*g* and the locking shaft 12*b* are also provided on a side surface of the unit main body 12A in the Y2 direction.

The bearing holders 12*g* and locking shafts 12*b* are used for positioning the transfer roller unit 12 inside the printer section 3.

A bearing 12*f* and a locking member abutting part 12*h* are provided in each bearing holder 12*g*.

A shaft for the secondary transfer roller 28*b* is inserted through the bearings 12*f*. The bearing 12*f* thus rotatably supports the secondary transfer roller 28*b*.

When the side cover unit 10 is closed, the bearing 12*f* is locked to (engaged with) a locking member 14 inside the printer section 3.

The locking member abutting part 12*h* is a recessed part extending in the Y direction and recessed upward. The locking member abutting part 12*h* can abut on a press roller 18. The locking member abutting part 12*h* receives a pressing force from the press roller 18 when abutting the press roller 18.

The locking shaft 12*b* extends in parallel with the bearing 12*f*, but below the bearing 12*f*. When the side cover unit 10 is closed, the locking shaft 12*b* is locked to the locking member 14 in the printer section 3.

The unit main body 12A provided with the bearing holder 12*g* and the bearing 12*f* is a support body that supports the secondary transfer roller 28*b*.

The second conveyance guide part 12*e* faces a corresponding conveyance guide part disposed in the printer section 3. The second conveyance guide part 12*e* forms the conveyance path 30B together with the corresponding conveyance guide part.

As illustrated in FIG. 3, the cover main body 11 and the transfer roller unit 12 are connected (in the X-direction) to each other by links 13 at opposite end in the Y direction, respectively. FIG. 3 illustrates a state in which the link 13 is folded. In such a case, the transfer roller unit 12 is at its closest to the transfer roller unit holding part 11*e*, and the transfer roller unit 12 is held by the transfer roller unit holding part 11*e*.

The transfer roller unit holding part 11*e* is provided with an engagement holder 11*h* that serves to regulate movement of the transfer roller unit 12. An engagement part 12*i* provided on the side of the transfer roller unit 12 in the Y1 direction engages with the engagement holder 11*h*.

Specifically, as illustrated in FIG. 4, an engagement shaft 12*j* protruding in the Y1 direction is arranged in the engagement part 12*i*, and the engagement shaft 12*j* is inserted into a recessed portion of the engagement holder 11*h*. The recessed portion of the engagement holder 11*h* is formed in a polygonal shape capable of two-dimensionally guiding the engagement shaft 12*j* in a ZX plane. Accordingly, the transfer roller unit 12 is movably held by the transfer roller unit holding part 11*e* within an area of the recessed part of the engagement holder 11*h* and within a movable area of the link 13. That is, when the side cover unit 10 is opened and closed, the recessed part of the engagement holder 11*h* includes a guide surface on which the engagement shaft 12*j* slides when gravity acts on the transfer roller unit 12.

Although not particularly illustrated, the engagement holder 11*h*, the engagement part 12*i*, and the engagement shaft 12*j* having a shape and arrangement that are plane-symmetric with respect to a plane parallel to the ZX plane are also provided on a side part of the cover main body 11 and the transfer roller unit 12 in the X2 direction.

In FIGS. 3 and 4, of the links 13, a link 13F on the front side (Y1 direction side) of the image forming apparatus 100 is illustrated.

The link 13F includes a first link 13*a* and a second link 13*b*. A link 13 on the rear side (Y2 direction side) of the image forming apparatus 100 depicted in FIG. 3 also includes a first link 13*a* and a second link 13*b* which are structurally the same as those of the link 13F. Hereinafter, a configuration of each link 13 will be described with the example of the link 13F.

As illustrated in FIG. 4, an end part of the first link 13*a* in the X1 direction is rotatably connected to the Y1 direction side surface of the transfer roller unit holding part 11*e* via a rotating support shaft 13*c* extending in the Y direction.

Another end part of the first link 13*a* is connected to an end part of the second link 13*b* by a rotating joint 13*d*.

Another end part of the second link 13*b* is rotatably connected to the Y1 direction side surface of the unit main body 12A via a rotating support shaft 13*e* extending in the Y direction.

When the cover main body 11 rotates in a clockwise direction illustrated in FIG. 4, each engagement shaft 12*j* slides on the guide surface in the recessed part of the engagement holder 11*h* due simply to the weight of the transfer roller unit 12, and can move in an oblique direction descending as moving towards the X2 direction. At this time, an opening angle of each link 13 would expand from the folded state illustrated in the drawing. At least a part of the transfer roller unit 12 can be separated from the transfer roller unit holding part 11*e* at this time.

Next, a relationship between the cover main body 11 and the apparatus main body 101 of the printer section 3 will be described.

Figure 5:
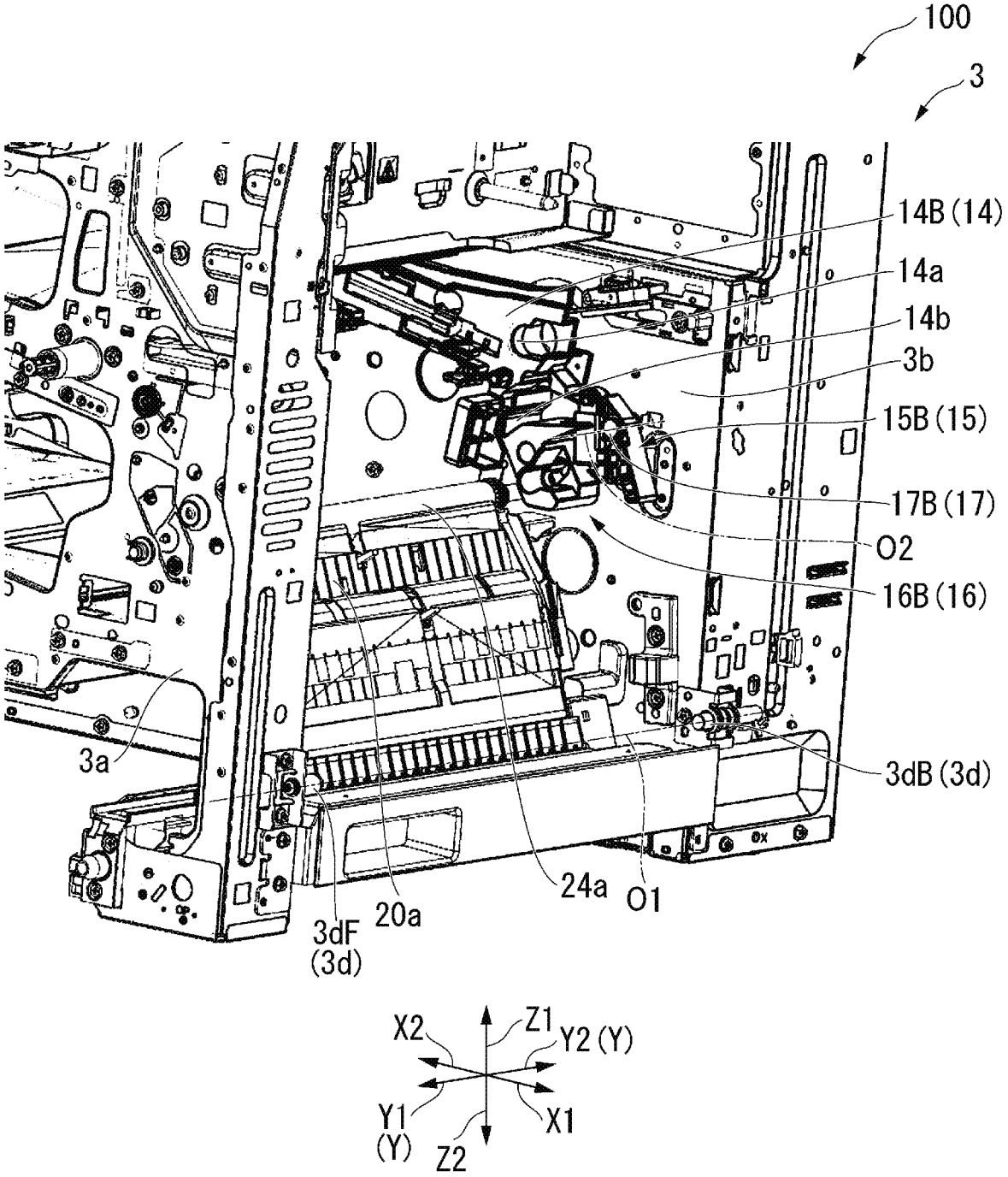
FIG. 5 is a schematic perspective view illustrating the inside (rear side view) of the main body.
Figure 6:
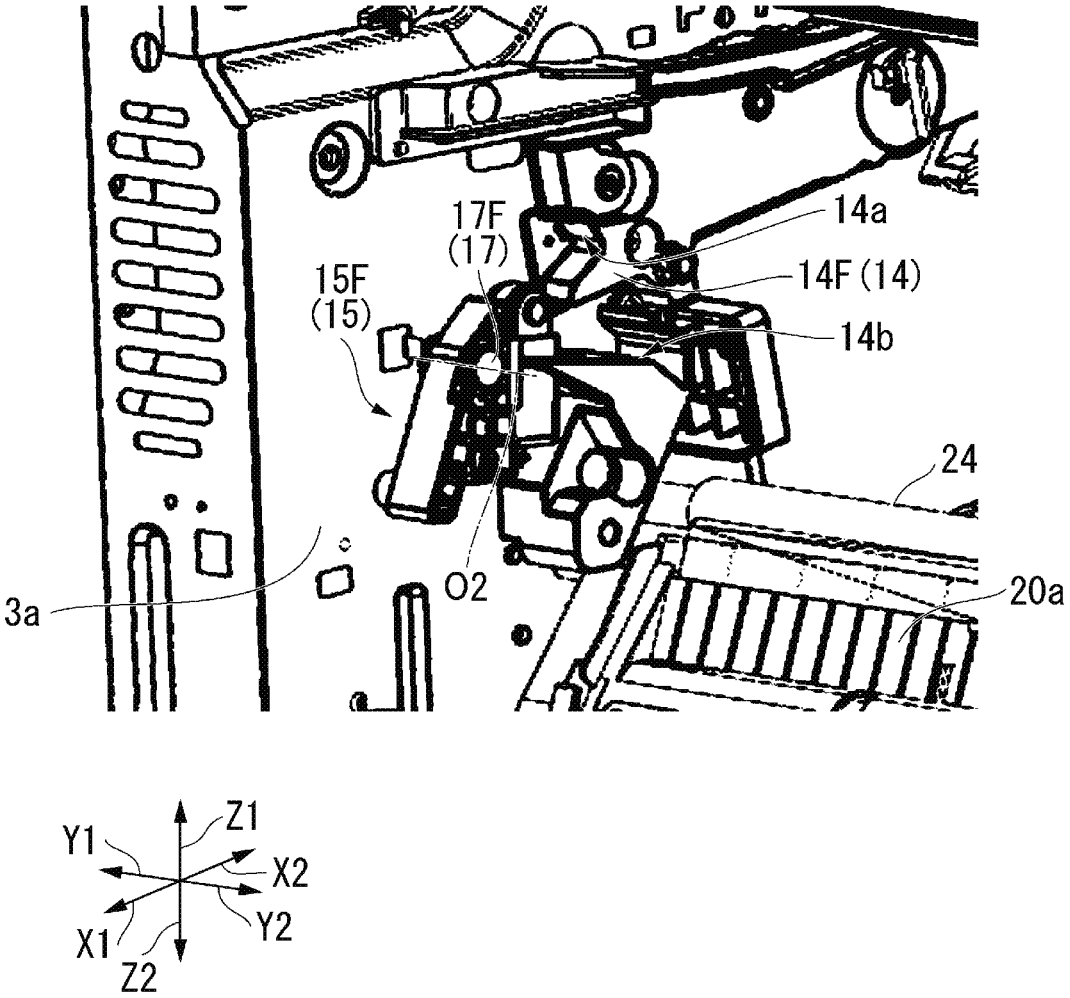
FIG. 6 is a schematic perspective view illustrating the inside (front side view) of the main body.

FIG. 5 is a schematic perspective view illustrating the inside (from rear side angle) of the printer section 3 in the image forming apparatus 100 according to the embodiment. FIG. 6 is a schematic perspective view illustrating the inside (from front side angle) of the printer section 3 in the image forming apparatus 100 according to the embodiment.

As illustrated in FIG. 5, the printer section 3 includes the front side plate 3*a* (as a main body frame portion) and the rear side plate 3*b* (as a main body frame portion).

The front side plate 3*a* and the rear side plate 3*b* are provided inside the front side (Y1 direction side) and inside the rear side (Y2 direction side) of the printer section 3, respectively. The front side plate 3*a* and the rear side plate 3*b* are connected to each other by various spanning structures or components in the Y direction. For example, a conveyance guide part 20*a* on the apparatus main body side of the conveyance path 5 (see FIG. 1) is installed below the front side plate 3*a* and the rear side plate 3*b*. The first roller 24*a* is disposed extending in the Y direction in the vicinity of the upper part of the conveyance guide part 20*a*.

A distance between the front side plate 3*a* and the rear side plate 3*b* is approximately equal to a width of the cover main body 11 in the Y direction.

The support shaft 3*d*B (rotating support part) protrudes in the Y1 direction from the surface of the rear side plate 3*b*. The support shaft 3*d*F (rotating support part) protrudes in the Y2 direction from the front sideplate 3*a*. The support shafts 3*d*B and 3*d*F are disposed coaxially with the first axis O1. Hereinafter, when it is not particularly required to distinguish between the support shafts 3*d*B and 3*d*F, each of the support shafts 3*d*B and 3*d*F may be simply referred to as a support shaft 3*d*.

Each support shaft 3*d* is inserted into a hole part 11*f* in the cover main body 11, and is fitted to each hole part 11*f* so as to permit rotation about the first axis O1. Accordingly, the cover main body 11 is rotatably supported by support shafts 3*d* between the front side plate 3*a* and the rear side plate 3*b*.

As illustrated in FIG. 5, on the Y1 direction side facing surface of the rear side plate 3*b*, a locking member 14B and a pressing mechanism 15B are provided above the first roller 24*a* and the conveyance guide part 20*a*.

The locking member 14B serves to position an end part of the transfer roller unit 12 of side cover unit 10.

The pressing mechanism 15B presses the end part of the transfer roller unit 12, thereby pressing the transfer roller unit 12 against the locking member 14B. The pressing of the pressing mechanism 15B can be released with the rotation of the side cover unit 10 around the first axis O1.

As illustrated in FIG. 6, a locking member 14F and a pressing mechanism 15F are provided on the Y2 direction facing surface of the front side plate 3*a*.

The locking member 14F and the pressing mechanism 15F have a shape and arrangement that are plane-symmetric with respect to a plane that bisects the distance between the front side plate 3*a* and the rear side plate 3*b* in the Y direction. Accordingly, the locking member 14F and the pressing mechanism 15F respectively have the same functions as those of the locking member 14B and the pressing mechanism 15B with respect to an end part of the transfer roller unit 12.

Hereinafter, when it is not particularly required to distinguish between the locking members 14F and 14B, each of the locking members 14F and 14B may be simply referred to as the locking member 14. When it is not particularly required to distinguish between the pressing mechanisms 15F and 15B, each of the pressing mechanisms 15F and 15B may be simply referred to as a pressing mechanism 15.

Hereinafter, configurations of the locking members 14 and the pressing mechanisms 15 will be described with an example of a locking member 14F and a pressing mechanism 15F.

As illustrated in FIG. 6, the locking member 14F includes a first locking groove 14*a* that engages the bearing 12*f* and a second locking groove 14*b* that engages the locking shaft 12*b*.

As illustrated in a cross-section shape of FIG. 4, the first locking groove 14*a* includes an upper part 14*c* and a lower part 14*d*. The first locking groove 14*a* is open towards the X1 direction.

The upper part 14*c* is a circular arc-shaped recessed part capable of covering an upper portion of the bearing 12*f* from above.

The lower part 14*d* is inclined obliquely downward (towards Z2 direction) along the X1 direction. Therefore, when the bearing 12*f* advances in the X2 direction and abuts on the lower part 14*d*, the bearing 12*f* can be guided obliquely upward along the inclination of the lower part 14*d*. When the bearing 12*f* abuts on both the upper part 14*c* and the lower part 14*d*, the bearing 12*f* is appropriately positioned in a direction along the front side plate 3*a* by the first locking groove 14*a*.

The second locking groove 14*b* serves to position the transfer roller unit 12 around the rotation center of the bearing 12*f* as positioned in the first locking groove 14*a*.

The second locking groove 14*b* includes a lower part 14*e*, an upper part 14*g*, and an inlet guide part 14*f*.

The lower part 14*e* and the upper part 14*g* are formed by plate-shaped parts that are parallel to each other, and form a groove part opening obliquely upward along the X1 direction. A width between the lower locking part 14*e* and the upper locking part 14*g* is a size that allows the locking shaft 12*b* to be slidably fitted.

The inlet guide part 14*f* receives a lower surface of the locking shaft 12*b* from below and guides the locking shaft 12*b* toward an opening between the lower locking part 14*e* and the upper locking part 14*g*. The inlet guide part 14*f* extends obliquely upward at an angle shallower than the inclination of the lower locking part 14*e* from an end part of the opening side of the lower locking part 14*e* disposed below the upper locking part 14*g*.

The locking member 14F is formed of, for example, a resin molded product having good slidability with the outer periphery of the bearing 12*f* and the locking shaft 12*b*. The locking member 14F is fixed to the front side plate 3*a* by, for example, a screw.

As illustrated in FIG. 6, a rotating support shaft 17F extending in the Y2 direction from the front side plate 3*a* is inserted into the pressing mechanism 15F. The central axis of the rotating support shaft 17F is a second axis O2 that is parallel to the first axis O1. The pressing mechanism 15F is rotatably supported around the second axis O2 by the rotating support shaft 17F.

As illustrated in FIG. 5, a rotating support shaft 17B extending in the Y1 direction coaxially with the second axis O2 from the rear side plate 3*b* is inserted into the pressing mechanism 15B. The pressing mechanism 15B is rotatably supported around the second axis O2 by the rotating support shaft 17B.

Hereinafter, when it is not particularly required to distinguish between the rotating support shafts 17F and 17B, each of the rotating support shafts 17F and 17B may be simply referred to as a rotating support shaft 17.

Figure 7:
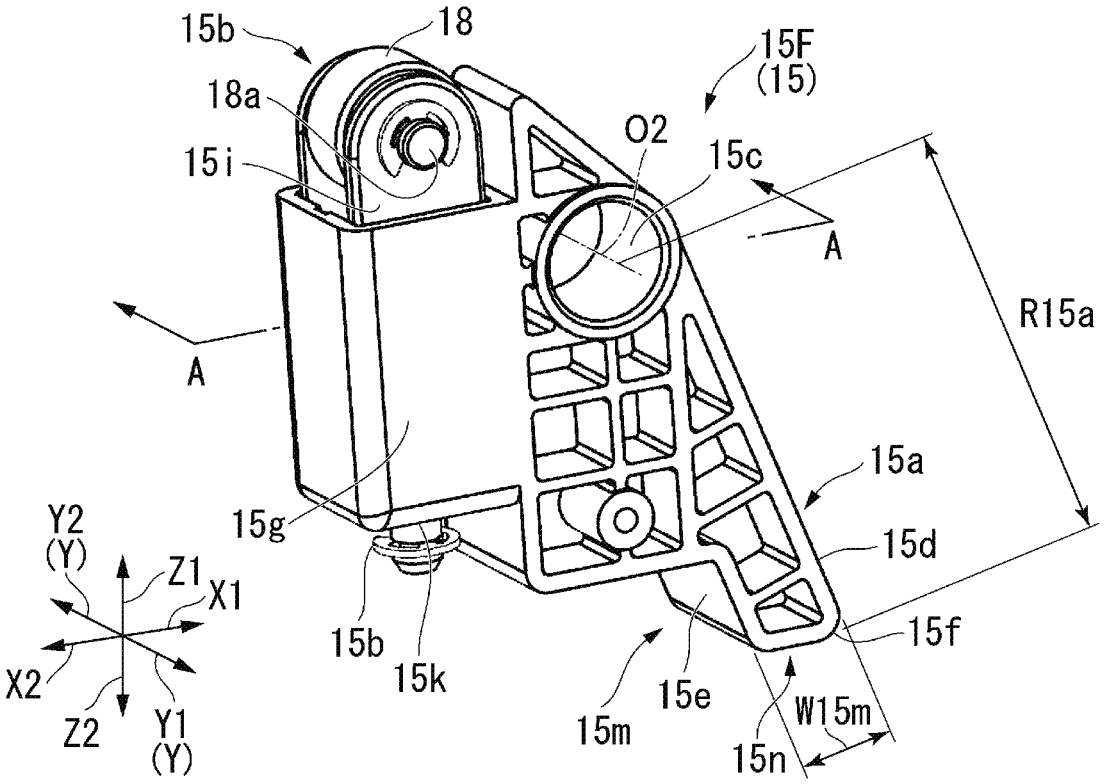
FIG. 7 is a schematic perspective view illustrating an example of a pressurizing mechanism.
Figure 8:
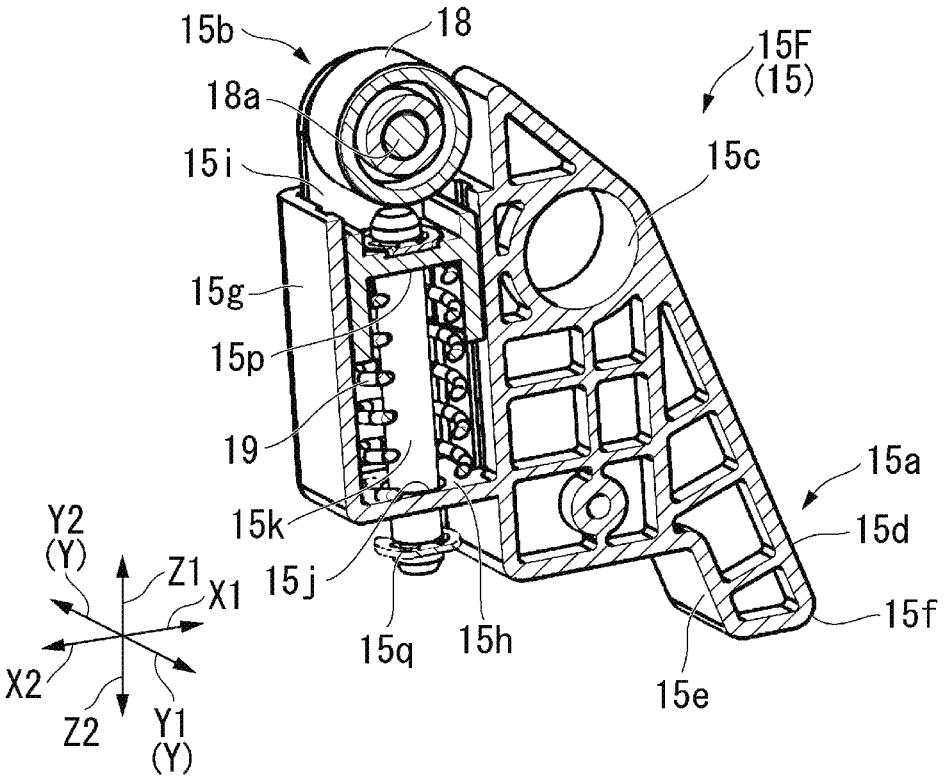
FIG. 8 is a schematic view of a cross section taken along the line A-A in FIG. 7.

The pressing mechanism 15F illustrated in FIGS. 7 and 8 depicts a posture that would occur when pressing on the transfer roller unit 12 as positioned by locking members 14. Hereinafter, unless otherwise specified, the configuration of each part of the pressing mechanism 15F will be described by reference this particular posture, though as described the posture is changeable.

The pressing mechanism 15F includes: a hole part 15*c* for rotatably fitting the rotating support shaft 17F which is not illustrated; the lever part 15*a* extending from the outside of the hole part 15*c*; and a pressing part 15*b* provided toward the X2 direction side from the hole part 15*c*.

The lever part 15*a* extends in an oblique direction toward the Z2 direction as advancing in the X1 direction. Particularly, a protruding part 15*m* extending in the above-described direction along an axis orthogonal to the second axis O2 is formed at a tip part of the lever part 15*a* in the extending direction. A surface on the X1 direction side in the protruding part 15*m* is formed by a first surface 15*d*, and a surface on the X2 direction side in the protruding part 15*m* is formed by a second surface 15*e*, respectively. The first surface 15*d* and the second surface 15*e* are planes that are parallel to each other. A distance between the first surface 15*d* and the second surface 15*e* is indicated by W15*m*.

A tip of the protruding part 15*m* in the Z2 direction is formed of a lower surface 15*n* along an approximately horizontal plane. Therefore, a distance R15*a* between a tip edge part 15*f* formed at an intersection of the lower surface 15*n* and the first surface 15*d* and the second axis O2 represents a rotation radius of the lever part 15*a* when the lever part 15*a* rotates around the second axis O2.

The pressing part 15*b* presses the locking member abutting part 12*h* from below.

As illustrated in FIG. 8, the pressing part 15*b* includes the press roller 18, a press roller holder 15*i*, a holder guide part 15*g*, and a spring 19.

The press roller 18 is rotatably supported by a rotating support shaft 18*a* extending in the Y direction. The press roller 18 can abut against the locking member abutting part 12*h* from below.

The press roller holder 15*i* supports the rotating support shaft 18*a* at an upper part. A spring accommodating part 15*p*, which holds an upper end part of the spring 19, is provided below the press roller holder 15*i*.

A guide shaft 15*k* extending in the longitudinal direction of the holder guide part 15*g* protrudes downward at a central part of the spring accommodating part 15*p*.

The holder guide part 15*g* is a tubular part that is long in the Z direction and open at an upper part. Inside the holder guide part 15*g*, the press roller holder 15*i* is movably accommodated along the longitudinal direction thereof.

A guide hole 15*j* through which the guide shaft 15*k* is inserted passes through a central part of a bottom surface 15*h* of the holder guide part 15*g*. The spring 19 is formed of a compression coil spring and is inserted between the bottom surface 15*h* and the spring accommodating part 15*p*. Further, since the spring 19 in FIG. 8 depicts a state during pressing, the spring 19 is compressed more than in its natural, uncompressed state.

The guide shaft 15*k* passes through the inside of the coil of spring 19 and is inserted into the guide hole 15*j*. A stopper part 15*q* is formed at a tip part of the guide shaft 15*k* by, for example, a C ring, or the like.

Next, a detailed configuration example of the engagement part 16 will be described with an example of the engagement part 16F.

Figure 9:
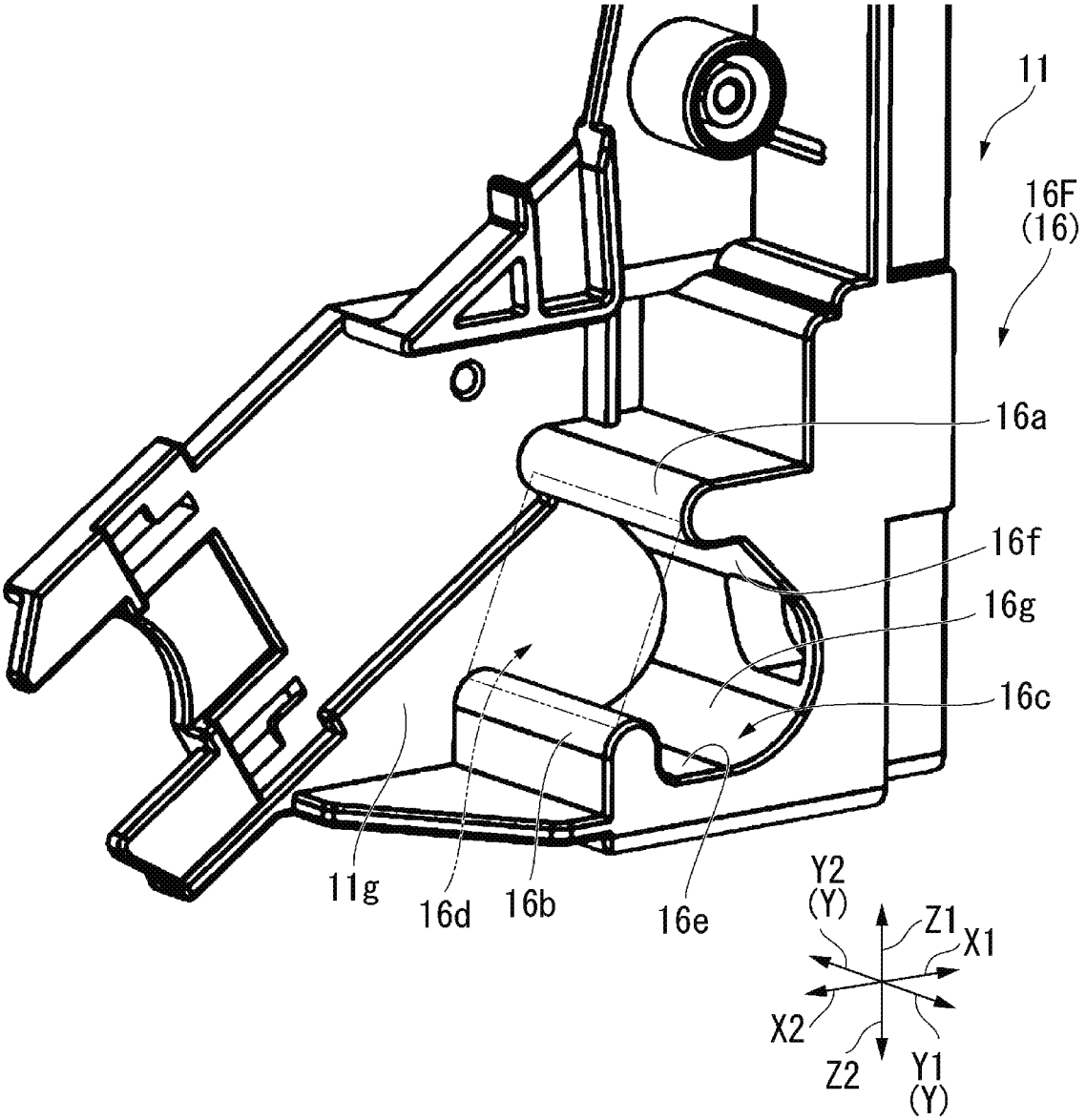
FIG. 9 is a schematic perspective view illustrating an example of an engagement part.

FIG. 9 is a schematic perspective view illustrating an example of the engagement part in the image forming apparatus according to the embodiment.

As illustrated in FIG. 9, the engagement part 16F protrudes in the Y1 direction from a side surface part 11*g* of the cover main body 11 in the Y1 direction. The engagement part 16F is formed in an approximately U-shaped groove shape having a groove part 16*c* that is recessed in the approximately X1 direction as a whole when viewed from the Y direction. More specifically, the groove part 16*c* has a groove shape in which respective end parts in the X1 direction of a groove inner surface 16*e* on the Z2 direction side extending in the X direction and a groove inner surface 16*g* on the Z1 direction side formed of a slope toward the Z2 direction as advancing in the X1 direction are connected by a curved surface 16*g* protruding in the X direction.

A protruding amount of the engagement part 16F is wider than a width of the lever part 15*a* in the Y direction in the pressing mechanism 15F.

A first pressing part 16*a* and a second pressing part 16*b* extending in the Y direction are formed at respective opening ends of the groove part 16*c* in the Z1 direction and the Z2 direction. A rectangular-shaped opening part 16*d* that is open in the approximately X2 direction and communicated with the groove part 16*c* is formed between the first pressing part 16*a* and the second pressing part 16*b*.

As illustrated in FIG. 4, the first pressing part 16*a* protrudes in the X2 direction from an opening end on the Z1 direction side in the groove part 16*c*. A tip part of the first pressing part 16*a* in the protruding direction is rounded in a circular arc shape.

The second pressing part 16*b* protrudes in the Z1 direction from an opening end on the Z2 direction side in the groove part 16*c*. A tip part of the second pressing part 16*b* in the protruding direction is rounded in a circular arc shape.

Each tip of the first pressing part 16*a* and the second pressing part 16*b* in the protruding direction is aligned on a plane slightly more inclined in the X1 direction than a vertical plane. Therefore, when counterclockwise angles illustrated in the drawing from the vertical plane including the first axis O1 and orthogonal to the X direction to the first pressing part 16*a* and the second pressing part 16*b* are respectively represented as θ1 and θ2 (where θ1 and θ2 are acute angles), θ2 is larger than θ1.

That is, when a rotating direction (counterclockwise direction as illustrated in the drawing) that rotates from an open state of the cover main body 11 to a closed state thereof is defined as a positive direction, each second pressing part 16*b* in the cover main body 11 is provided at a position where each second pressing part 16*b* rotates more in the positive direction than each first pressing part 16*a*.

When the side cover unit 10 illustrated in FIG. 4 is closed, the engagement part 16F is disposed at a position where the lever part 15*a* of the pressing mechanism 15F is inserted into the groove part 16*c* and the first pressing part 16*a* abuts on the first surface 15*d* of the lever part 15*a*. Such an arrangement position of the lever part 15*a* is a first position where the pressing part 15*b* presses the unit main body 12A via the locking member abutting part 12*h*.

At the first position, the second surface 15*e* of the lever part 15*a* is more separated in the X1 direction than the second pressing part 16*b*, and the lower surface 15*n* is more separated in the Z1 direction than the groove part 16*c*.

According to the configuration, each first pressing part 16*a* and each second pressing part 16*b* are disposed in opposite directions with the lever part 15*a* interposed therebetween when the cover main body 11 is closed.

A rotation radius R16*b* of the second pressing part 16*b* around the first axis O1 is shorter than a rotation radius R16*a* of the first pressing part 16*a* around the first axis O1.

In the embodiment, the rotation radii R16*a* and R16*b* are both longer than the rotation radius R15*a* around the second axis O2 of the lever part 15*a*.

A rotation trajectory of the tip of the lever part 15*a* represented by a circular arc of the radius R15*a* around the second axis O2 intersects with a rotation trajectory of the tips of the first pressing part 16*a* and the second pressing part 16*b* represented by circular arcs of the radii R16*a* and R16*b* around the first axis O1.

As described above, when the side cover unit 10 is closed, the first pressing part 16*a* presses the first surface 15*d*, whereby a rotation position around the second axis O2 of the pressing mechanism 15F is set to the first position. At this time, the pressing roller 18 in the pressing mechanism 15F is fitted to the locking member abutting part 12*h* from below, and presses the locking member abutting part 12*h* upward.

Thus, a moment by an external force from the locking member abutting part 12*h* acts on the transfer roller unit 12, after which the bearing 12*f* is locked to the first locking groove 14*a*, and the locking shaft 12*b* is locked to the second locking groove 14*b*, respectively.

In the above, the engagement between the pressing mechanism 15F and the engagement part 16F when the side cover unit 10 is closed, and the locking state between the transfer roller unit 12 and the locking member 14F at the side surface part in the Y1 direction are described. Although not specifically illustrated, the same also applies to engagement between the pressing mechanism 15B and the engagement part 16 on the Y2 direction side at the side surface part in the Y2 direction, and a locking state between the transfer roller unit 12 and the locking member 14B at the side surface part in the Y2 direction.

Next, an operation of the image forming apparatus 100 will be described focusing on an operation thereof when the side cover unit 10 is opened and closed.

First, an image forming operation of the image forming apparatus 100 will be briefly described.

In the image forming apparatus 100 illustrated in FIG. 1, image formation is started by an operation of the control panel 1 or an external signal. Image information is transmitted to the printer section 3 by the scanner section 2 reading an object to be copied, or transmitted to the printer section 3 from the outside. The printer section 3 supplies the sheet S from the sheet supply section 4 to the registration roller 24. The main body control section 6 selects the sheet S supplied from the sheet supply section 4 based upon the operation of the control panel 1 or the external signal.

When an operation input of the image formation is performed from the control panel 1, the main body control section 6 performs control for starting paper feeding from the paper feeding cassette and the image formation.

The image forming sections 25Y, 25M, 25C, and 25K form an electrostatic latent image on each photosensitive drum 7 based upon the image information corresponding to each color. Each electrostatic latent image is developed by the developing device 8. Therefore, a toner image corresponding to the electrostatic latent image is formed on the surface of each photosensitive drum 7.

Each toner image is primarily transferred to the intermediate transfer belt 27 by each transfer roller. As the intermediate transfer belt 27 moves, each toner image is sequentially superimposed without causing color shift and sent to the transfer section 28.

The sheet S is fed from the registration roller pair 24 to the transfer section 28. The toner image reaching the transfer section 28 is then transferred to the sheet S. The transfer of the toner image from the transfer section 28 to the sheet S is referred to as a secondary transfer. The transferred toner image is then fixed on the sheet S by the fixing device 29. An image is thus formed on the sheet S.

Next, the operation when the side cover unit 10 is opened and closed will be described.

Figure 10:
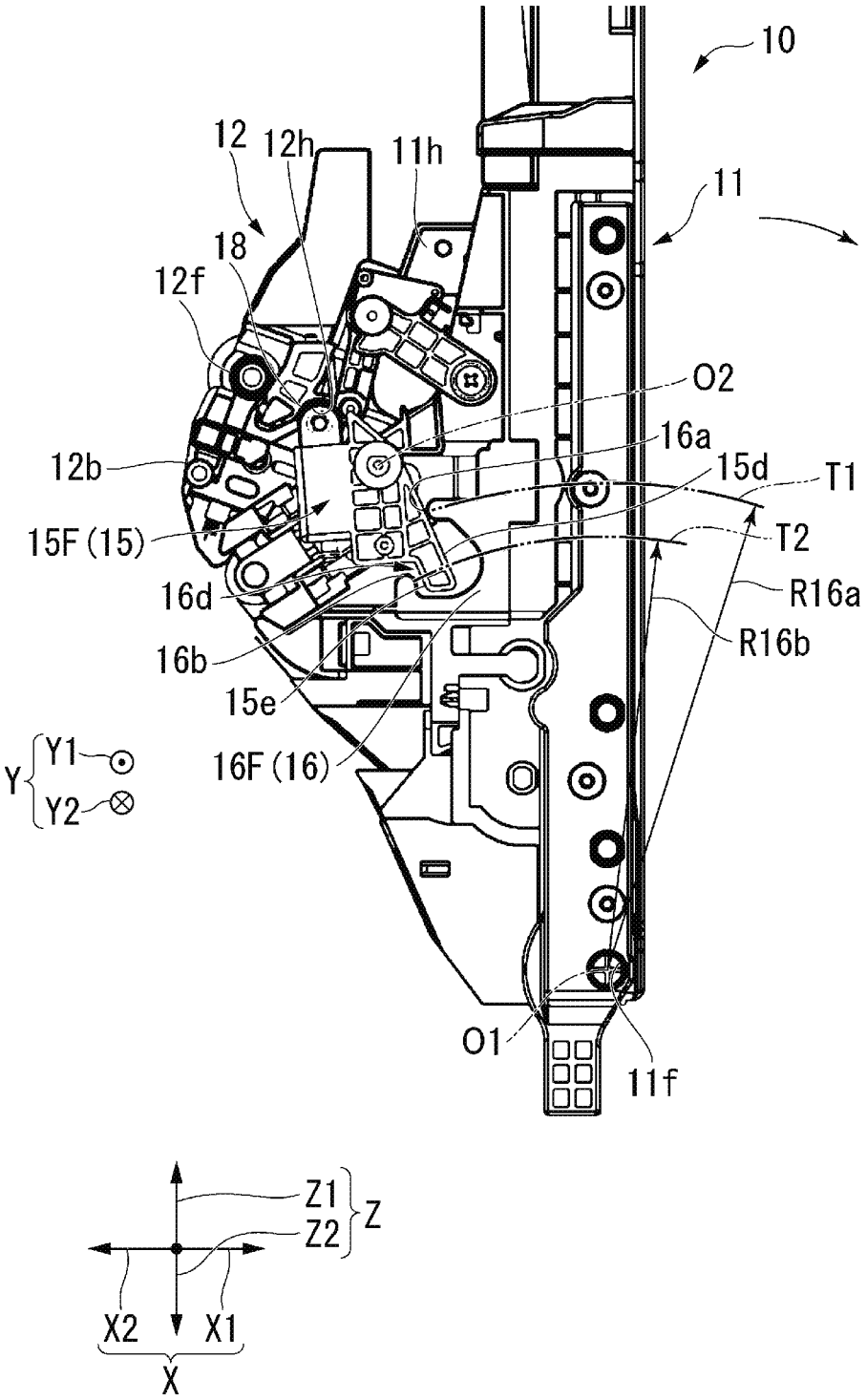
FIG. 10 is an operation explanatory view of the image forming apparatus according to the embodiment.
Figure 11:
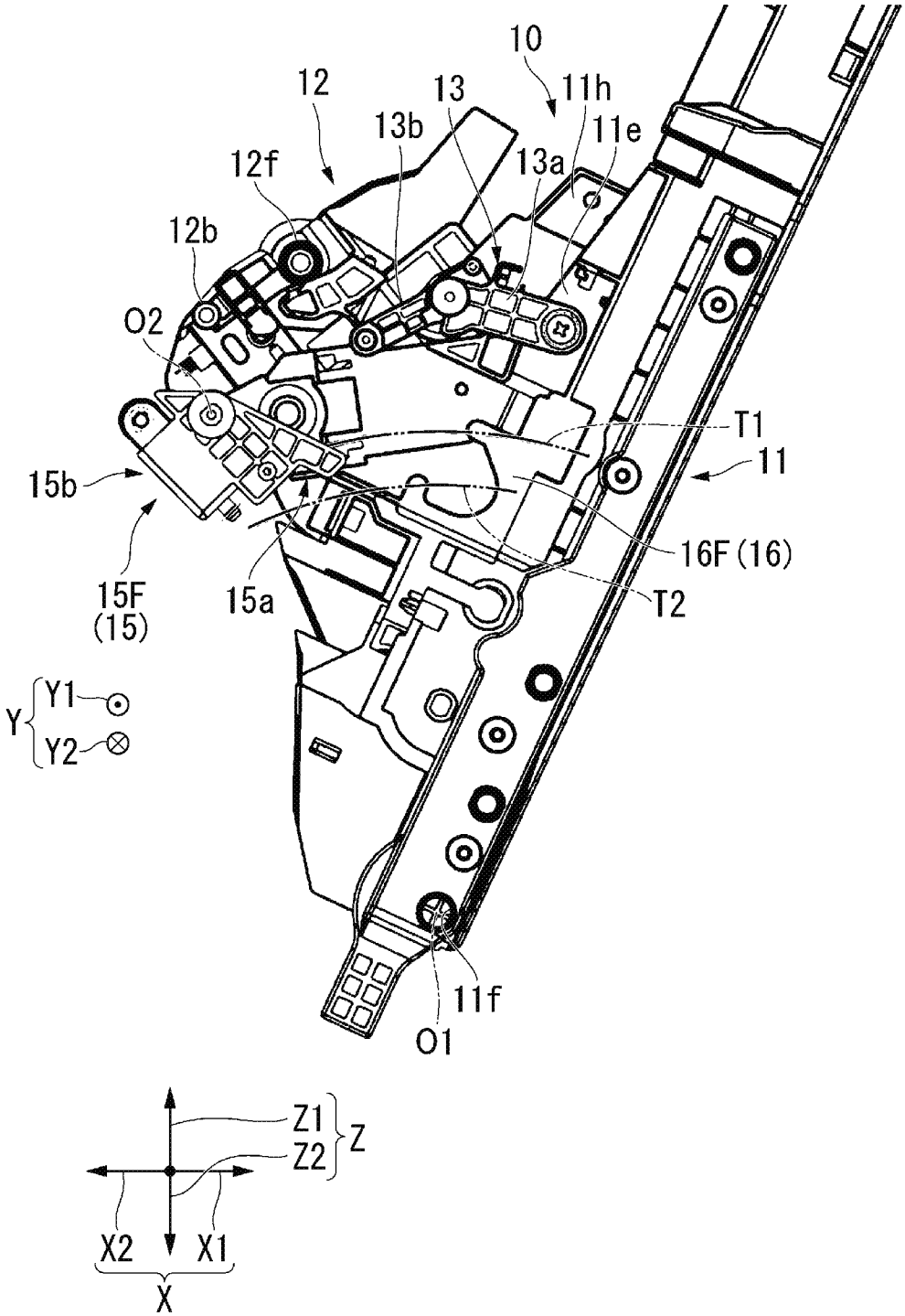
FIG. 11 is an operation explanatory view of the image forming apparatus.
Figure 12:
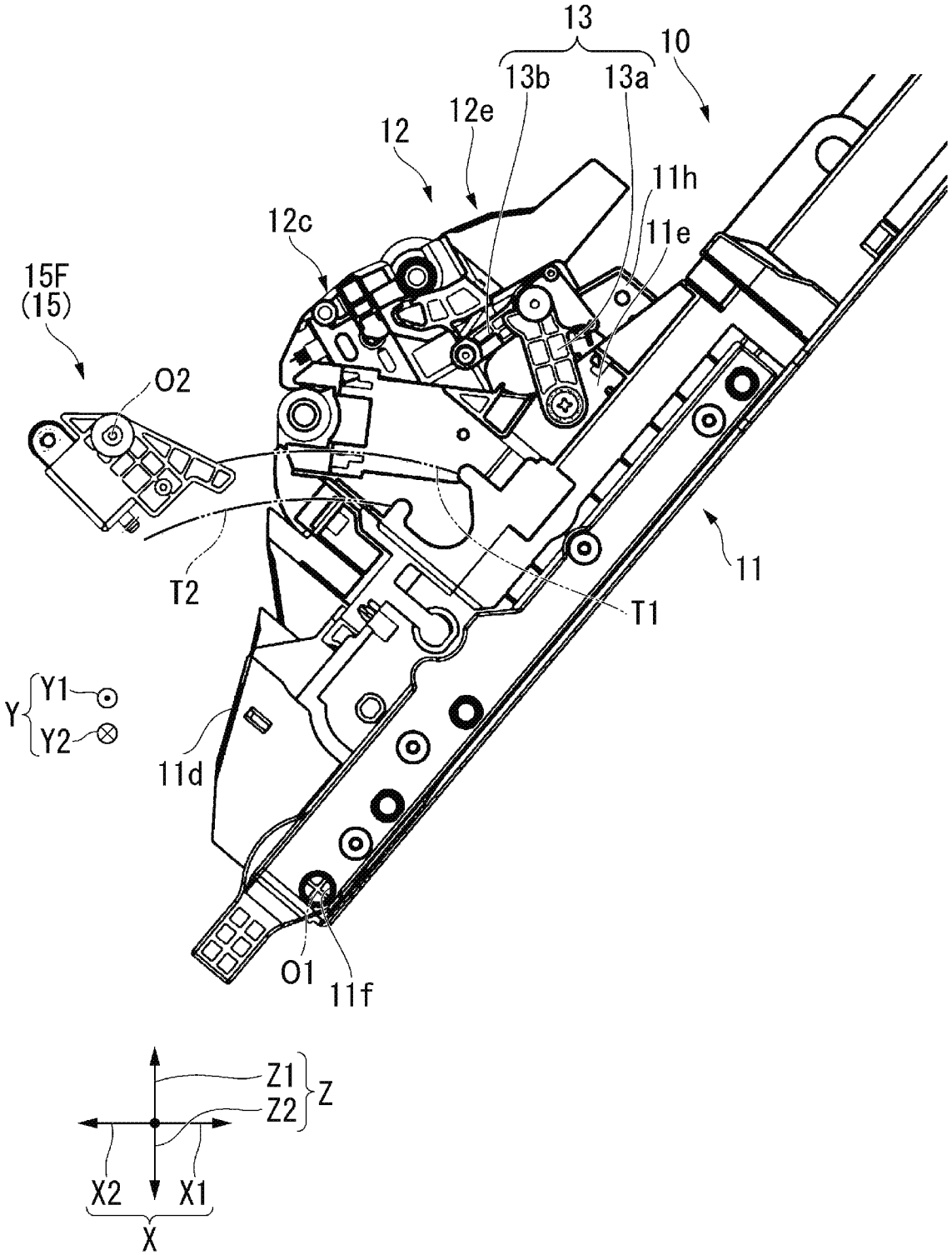
FIG. 12 is an operation explanatory view of the image forming apparatus.

FIGS. 10 to 12 are operation explanatory views in the image forming apparatus according to the embodiment.

In addition, in FIGS. 10 to 12, with respect to the members disposed on the opposite sides in the Y direction, only the members on the Y1 direction side are illustrated. Therefore, hereinafter, an operation of the members on the Y1 direction side will be described. However, the same operation is realized by the corresponding members on the Y2 direction side.

FIG. 10 illustrates a state when the side cover unit 10 is closed, which is the same as that of FIG. 4. Here, the illustration of the locking member 14F is omitted.

When a user manipulates an operation part such as a handle, the side cover unit 10 can be opened in the X1 direction from a closed state.

At this time, the cover main body 11 in the side cover unit 10 rotates around the first axis O1 in the clockwise direction illustrated in the drawing. Since the engagement part 16F is fixed to the side surface part of the cover main body 11, the engagement part 16F rotates around the first axis O1 in the clockwise direction illustrated in the drawing in the same manner as that of the cover main body 11.

For example, when viewed from the Y direction, the first pressing part 16*a* and the second pressing part 16*b* rotate and move while drawing circular arc trajectories of the rotation radii R16*a* and R16*b*, respectively.

When the cover main body 11 starts to rotate, the first pressing part 16*a* is separated from the first surface 15*d* in the rotating direction, and the second pressing part 16*b* abuts on the second surface 15*e*. Further, when the rotation proceeds, the second pressing part 16*b* presses the second surface 15*e* in the rotating direction.

By a pressing force from the second pressing part 16*b*, a counterclockwise moment illustrated in the drawing acts on the lever part 15*a* of the pressing mechanism 15F with respect to the second axis O2. For this reason, the lever part 15*a* rotates around the second axis O2 in the counterclockwise direction illustrated in the drawing.

As a result, the lever part 15*a* is moved from the first position to the second position where the press roller 18 rides over an end part of the locking member abutting part 12*h* in the X2 direction. Thus, a force acting on the transfer roller unit 12 from the pressing mechanism 15F through the press roller 18 is released.

When moving to the second position, the spring 19 which is illustrated in an uncompressed state in association with an overriding operation of the press roller 18. Therefore, an operating force for rotating the side cover unit 10 is temporarily increased by the reaction from the pressing mechanism 15F. However, the second pressing part 16*b* is in contact with the tip part of the lever part 15*a* in the protruding direction. Therefore, in comparison with a case of abutting on a position closer to the second axis O2, the lever action is increased and thus the operating force is reduced.

When the pressing mechanism 15F further rotates in the counterclockwise direction as illustrated in the drawing, the extending direction of the lever part 15*a* approaches horizontal by rotation of the lever part 15*a*. As a result, the lever part 15*a* can pass between the opening parts 16*d* in the engagement part 16F. Accordingly, as illustrated in FIG. 11, engagement between the lever part 15*a* and the engagement part 16 is released, and the engagement part 16 can be smoothly separated from the pressing mechanism 15 in the rotating direction.

Accordingly, the cover main body 11 can further rotate in the X1 direction.

In the pressing mechanism 15F released from the engagement with the engagement part 16F and the abutting against the locking member abutting part 12*h*, the lever part 15*a* as illustrated in the drawing is maintained around the second axis O2 in a nearly horizontal posture by balance of mass. That is, in the pressing mechanism 15F, since the mass of the pressing part 15*b* is greater than that of the lever part 15*a*, the pressing mechanism 15F has a posture in which the pressing part 15*b* is on the lower side.

Here, in the posture described above, the tip part of the lever part 15*a* in the protruding direction is interposed between a rotation trajectory T1 of the tip part of the first pressing part 16*a* and a rotation trajectory T2 of the tip part of the second pressing part 16*b*.

As illustrated in FIG. 11, when the cover main body 11 is inclined, the transfer roller unit 12 is inclined at an angle different from that of the cover main body 11 by the self-weight of the transfer roller unit 12. Thus, an angle formed by the first link 13*a* and the second link 13*b* in the link 13 increases. The transfer roller unit 12 is inclined in a direction approaching horizontal on the transfer roller unit holding part 11*e*. Accordingly, a position of the bearing 12*f* with respect to the locking shaft 12*b* falls in the X1 direction, and the bearing 12*f* further moves toward the X1 direction in the X direction.

FIG. 12 illustrates a state in which the cover main body 11 is rotated as much as possible in the X1 direction. By the time the aforementioned state is reached, the transfer roller unit 12 moves to a position held on the transfer roller unit holding part 11*e* by the mass balance, similarly to the case when the side cover unit 10 is closed. Therefore, an opening angle between the first link 13*a* and the second link 13*b* in the link 13 is also the same as an opening angle at the time of closing.

In this manner, when the cover main body 11 is rotated as much as possible in the X1 direction, the side cover unit 10 is opened.

When side cover unit 10 is opened, the transfer roller unit 12 is held at a fixed position on the transfer roller unit holding part 11*e*. Accordingly, the secondary transfer roller 28*b* is separated from the intermediate transfer belt 27. A roller surface of the secondary transfer roller 28*b* is directed toward the Z1 direction.

The first conveyance guide part 12*c* and the second conveyance guide part 12*e* in the transfer roller unit 12, and the conveyance guide part 11*d* in the cover main body 11 are separated from respective conveyance guide parts on the apparatus main body side, which face each other. Thus, a part of the conveyance path of the conveyance mechanism 5, and the conveyance paths 30A and 30B are open.

Therefore, when the jam of the sheet S occurs at a part of the conveyance path of the conveyance part 5 and any part of the conveyance paths 30A and 30B, the jammed sheet S can be removed by opening the side cover unit 10.

Hereinabove, the operation of the side cover unit 10 is described from the closed state of the side cover unit 10 to the open state thereof. When the above-described operation is performed in reverse, the side cover unit 10 can be closed from the open state thereof.

At that time, when the user simply closes the cover main body 11, each engagement part 16 is engaged with the lever part 15*a* of each pressing mechanism 15, and each first pressing part 16*a* presses the first surface 15*d* in the positive direction of rotation, whereby each press roller 18 abuts on each locking member abutting part 12*h* as each pressing mechanism 15 rotates around the second axis O2 in the clockwise direction illustrated in the drawing. At this time, the spring 19 in each pressing part 15*b* is compressed, whereby a force is applied to both end parts of the transfer roller unit 12 in the Y direction.

Since the force of the spring 19 is applied in a direction slightly inclined in the X2 direction with respect to the Z1 direction, the horizontal component force is extremely small. Therefore, at the end of closing, in order to resist a reaction force component of the spring 19 in the X1 direction, it is not necessary for a user to substantially increase the force when the side cover unit 10 is closed. Therefore, with the image forming apparatus 100 according to an embodiment, the user can easily open and close the side cover unit 10.

When the side cover unit 10 is closed, each bearing 12*f* and each locking shaft 12*b* of the transfer roller unit 12 are locked to the respective locking members 14, and thus the posture of the transfer roller unit 12 is fixed. At this time, the secondary transfer roller 28*b* abuts on the intermediate transfer belt 27 at the secondary transfer position, and a nip for the secondary transfer is formed.

As described above, with the image forming apparatus 100 according to an embodiment, when the cover main body 11 is closed, the engagement part 16 is engaged with the lever part 15*a* of the pressing mechanism 15. Accordingly, the lever part 15*a* is rotated around the second axis O2, and the transfer roller unit 12 is locked to the locking member 14. As a result, the secondary transfer roller 28*b* is positioned at the secondary transfer position in the intermediate transfer belt 27. While the cover main body 11 is open, the engagement between the engagement part 16 and the lever part 15*a* is released in response to the rotation of the cover main body 11, and accordingly, the transfer roller unit 12 including the secondary transfer roller 28*b* rotates together with the cover main body 11, and the secondary transfer roller 28*b* is separated from the intermediate transfer belt 27. As a result, the conveyance path is opened.

At the time of the above-described opening and closing, the force acting on the transfer roller unit 12 from the pressing mechanism 15 hardly contributes to the increase or decrease of the force necessary for the opening and closing operation of the cover main body 11.

Therefore, the user can smoothly open and close the cover main body 11.

Thus, the cover can be smoothly opened and closed, and it is possible to provide an image forming apparatus capable of accurately positioning the roller with respect to the rotating body when the cover is closed.

Hereinafter, a modification example of the above-described example embodiment will be described.

In the above description, the first pressing part 16*a* and the second pressing part 16*b* are formed at the opening end of the groove part 16*c*. However, a space that does not interfere with the lever part 15*a* may be formed between the first pressing part 16*a* and the second pressing part 16*b*. The space need not form a groove. For example, the first pressing part and the second pressing part may be formed with pin members.

In the above description of the example embodiment, the engagement part 16 is described as including the first pressing part 16*a* and the second pressing part 16*b*. However, the engagement part is not limited to this configuration and, in general, any configuration can be adopted as long as the engagement part 16 can move a lever between a first position and a second position in association with the rotation of the cover. For example, the engagement part 16 may move the lever between the first position and the second position by pulling rather than pushing the lever in association with the rotation of the cover.

In the description of the example embodiment, it is described that the rotation radius of the second pressing part 16*b* is smaller than the rotation radius of the first pressing part 16*a* around the first axis O1. However, as long as the engagement can be released in such a manner that the lever passes between the first pressing part and the second pressing part, the rotation radius of the second pressing part 16*b* may be larger than the rotation radius of the first pressing part 16*a*. In such a case, resistance at the time of closing the cover may become smaller.

While certain embodiments have been described, these embodiments have been presented by way of example only, and are not intended to limit the scope of the present disclosure. Indeed, the novel embodiments described herein may be embodied in a variety of other forms; furthermore, various omissions, substitutions and changes in the form of the embodiments described herein may be made without departing from the spirit of the present disclosure. The accompanying claims and their equivalents are intended to cover such forms or modifications as would fall within the scope and spirit of the present disclosure.

What is claimed is:

1. An image forming apparatus, comprising:

a main body;

a rotating belt in the main body;

a roller supported by a support shaft that is configured to move the roller into contact with the rotating belt and to separate the roller from the rotating belt;

a pressing part in the main body configured to press the support shaft so that the roller presses against the rotating belt;

a lever that when moved causes the pressing part to move between a first position pressing the support shaft and a second position away from the support shaft;

a cover covering an outer periphery of the main body, the cover being rotatably supported about a first axis of a rotating support part in the main body so as to be openable and closable; and an engagement part that is fixed to the cover and moves on a circular arc around the first axis with rotation of the cover, the engagement part being positioned to engage the lever when the cover is closed such that the lever is at the first position and to release the lever when the cover is opened to permit the lever to move to the second position.

2. The image forming apparatus according to claim 1, wherein the engagement part includes:

a first pressing part that presses the lever toward the first position when the cover is closed; and a second pressing part that presses the lever in a direction opposed to a pressing direction of the first pressing part when the cover is opened.

3. The image forming apparatus according to claim 2, wherein a rotation radius of the second pressing part around the first axis is less than a rotation radius of the first pressing part around the first axis.

4. The image forming apparatus according to claim 2, wherein the first pressing part and the second pressing part are separable from the lever when the cover is opened.

5. The image forming apparatus according to claim 2, wherein when the cover rotates from an open state to a closed state, the second pressing part is positioned to rotate further than the first pressing part in the direction in which the cover rotates from the open state to the closed state.

6. The image forming apparatus according to claim 2, wherein the lever is interposed between the first pressing part and the second pressing part when the cover is in a closed state.

7. The image forming apparatus according to claim 1, wherein the cover when open exposes a conveyance path for a sheet.

8. The image forming apparatus according to claim 1, wherein the roller is a secondary transfer roller.

9. The image forming apparatus according to claim 1, further comprising:

a rotating member configured to rotate around a second axis parallel to the first axis, wherein the pressing part and the lever are on the rotating member, and the lever is positioned such that a rotational trajectory of the lever intersects with a rotational trajectory of the engagement part when the cover rotates.

10. The image forming apparatus according to claim 9, wherein a rotation radius of the lever around the second axis is shorter than a rotation radius of the pressing part around the first axis.

11. An image forming apparatus, comprising:

a main body;

a sheet conveyance path along which a sheet passes in the main body for processing of the sheet;

a rotating belt configured to contact the sheet on the conveyance path;

a roller supported by a support shaft that is configured to move the roller into contact with the rotating belt and to separate the roller from the rotating belt;

a pressing part in the main body configured to press the support shaft so that the roller presses against the rotating belt;

a lever that when moved causes the pressing part to move between a first position pressing the support shaft and a second position away from the support shaft;

a cover on the main body, the cover being rotatably supported about a first axis of a rotating support part in the main body so as to be openable and closable, the cover when in an open state exposing a portion of the sheet conveyance path; and an engagement part that is fixed to the cover and moves on a circular arc around the first axis with rotation of the cover, the engagement part being positioned to engage the lever when the cover is closed such that the lever is at the first position and to release the lever when the cover is opened to permit the lever to move to the second position.

12. The image forming apparatus according to claim 11, wherein the engagement part includes:

a first pressing part that presses the lever toward the first position when the cover is closed; and a second pressing part that presses the lever in a direction opposed to a pressing direction of the first pressing part when the cover is opened.

13. The image forming apparatus according to claim 12, wherein a rotation radius of the second pressing part around the first axis is less than a rotation radius of the first pressing part around the first axis.

14. The image forming apparatus according to claim 12, wherein the first pressing part and the second pressing part are separable from the lever when the cover is opened.

15. The image forming apparatus according to claim 12, wherein when the cover rotates from an open state to a closed state, the second pressing part is positioned to rotate further than the first pressing part in the direction in which the cover rotates from the open state to the closed state.

16. The image forming apparatus according to claim 12, wherein the lever is interposed between the first pressing part and the second pressing part when the cover is in a closed state.

17. The image forming apparatus according to claim 11, wherein the roller is a secondary transfer roller.

18. A printer apparatus, comprising:

a main body including therein an image forming unit configured to form toner images on a transfer belt;

a sheet conveyance path along which a sheet passes in the main body to contact the transfer belt;

a roller supported by a support shaft that is configured to move the roller into contact with the transfer belt and to separate the roller from transfer belt;

a pressing part in the main body configured to press the support shaft so that the roller presses against the transfer belt;

a lever that when moved causes the pressing part to move between a first position pressing the support shaft and a second position away from the support shaft;

a cover on the main body, the cover being rotatably supported about a first axis of a rotating support part in the main body so as to be openable and closable, the cover when in an open state exposing a portion of the sheet conveyance path; and an engagement part that is fixed to the cover and moves on a circular arc around the first axis with rotation of the cover, the engagement part being positioned to engage the lever when the cover is closed such that the lever is at the first position and to release the lever when the cover is opened to permit the lever to move to the second position.

19. The printer apparatus according to claim 18, wherein the engagement part includes:

a first pressing part that presses the lever toward the first position when the cover is closed; and a second pressing part that presses the lever in a direction opposed to a pressing direction of the first pressing part when the cover is opened.

20. The printer apparatus according to claim 19, wherein the lever is interposed between the first pressing part and the second pressing part when the cover is in the closed state.

* * * * *